US006609352B1

(12) United States Patent
Erlund et al.

(10) Patent No.: US 6,609,352 B1
(45) Date of Patent: Aug. 26, 2003

(54) MACHINE FOR FOLDING AND FILLING OF CONTAINERS FOR CD DISC

(75) Inventors: Åke Erlund, Spånga (SE); Staffan Leónarde, Allngsás (SE)

(73) Assignee: Stora Enso Activation AB (SE)

( * ) Notice: Subject to any disclaimer, the term of this patent is extended or adjusted under 35 U.S.C. 154(b) by 0 days.

(21) Appl. No.: 09/936,056

(22) PCT Filed: Mar. 2, 2000

(86) PCT No.: PCT/SE00/00415

§ 371 (c)(1),
(2), (4) Date: Feb. 12, 2002

(87) PCT Pub. No.: WO00/53503

PCT Pub. Date: Sep. 14, 2000

(30) Foreign Application Priority Data

Mar. 5, 1999 (SE) ..... 9900796

(51) Int. Cl.[7] ..... B65B 1/10; B65B 5/06

(52) U.S. Cl. ..... 53/254; 53/564; 53/558; 53/238; 53/155

(58) Field of Search ..... 53/254, 253, 564, 53/566, 558, 120, 117, 155, 238

(56) References Cited

U.S. PATENT DOCUMENTS 5,207,050 A * 5/1993 Fulkerson et al. ..... 53/474
5,285,620 A * 2/1994 Kaye et al. ..... 53/474
5,694,743 A * 12/1997 Beighle ..... 53/445
5,852,915 A * 12/1998 Williams et al. ..... 53/411
5,875,614 A * 3/1999 Youngs et al. ..... 53/455
5,890,346 A * 4/1999 Guess ..... 53/459
5,943,845 A * 8/1999 Ilsemann ..... 53/468
5,950,401 A * 9/1999 Blohm et al. ..... 53/411
6,032,435 A * 3/2000 Zaniboni ..... 53/117

* cited by examiner

*Primary Examiner*—Rinaldi I. Rada
*Assistant Examiner*—Hemant M. Desai
(74) *Attorney, Agent, or Firm*—Mark Mantague; Cowan Liebowitz & Latman, P.C.

(57) ABSTRACT

A machine for manufacturing packages for compact discs or similar out of cardboard work piece. The packages consist of a casing part and a slide part inserted therein, with a compact disc and a booklet. These two components are manufactured in separate tracks (A, B), which consist of jigs, whereby each of these rotates stepwise in a rotating table. The casing parts are manufactured by laying down the forward half of a work piece on a placing plate (1), laying down a cover (2) over this, the cover having the same outer shape as the inside of the finished casing, folding its edge upwards with first folding devices (7), folding over its edge with second folding devices (9, 10) applying melt glue on the top flap and laying down the rear half over disc, and squeezing by means of the second folding devices until the glue has stuck. After turning the folding devices away, the cover is turned upwards and the completed cover can be pulled off for being passed on to a ready position in front of a jig position in the second rotating table, where a jig, which during a work revolution has produced a finished slide part with disc and booklet inserted, by means of pushing means and funnel means passes this into the casing, standing in the ready position.

8 Claims, 5 Drawing Sheets

MACHINE FOR FOLDING AND FILLING OF CONTAINERS FOR CD DISC

BACKGROUND OF THE INVENTION

The invention relates to a machine which, preceding from work pieces of cardboard or the like, punched and provided with folding notches, folds and fills packages with disc shaped products, especially compact discs or the like, as being presented in the preamble of claim 1 here below. A machine of this type is known through SE-C-508483, and is adapted to raise packages and fill them with disc shaped products, especially compact discs, which packages are of the kind described in the publication WO/97/38919, as well as, in a special form, in the Swedish patent application No. 9900018-1. Many advantages are obtained, with such packages made out of cardboard, compared to presently more usual plastic packages. The known machine is built around two endless, stepwise or continuously feedable endless conveyors, which are arranged to linearly pass stations or carrying out a number of different work operations, and which conveyors meet each other in right angles to assemble casing parts from one of them with slide parts from the other. For this reason the whole apparatus becomes relatively voluminous. Consequently, among other things, it can not be transported without being disassembled, which results in work and waste of time for both disassembly and assembly.

SUMMARY OF THE INVENTION

It is an object of the present invention to provide a machine for corresponding purposes, which machine is compact enough to be mounted on one single bed, making factory installation and transport as a unit possible, for example for it to be moved around as an entirety, possibly with the exception of a cabinet for electric controls or the like, by means of a standard type fork-lift truck. It can then be delivered factory adjusted with air freight anywhere in the world to, as a rule, be started immediately. Another object is to provide a packaging machine of the stated type, which is fast and reliable. A third object is to provide a packaging machine of the stated type, having, to a greatest possible extent, computer controlled mechanisms instead of mechanical controls and co-operation by means of axles, gear-wheels, cam-wheels etc., throughout.

These and other advantageous objects are met by a machine of the type mentioned to begin with, being constituted as stated in the characterising portion of claim 1. Consequently the first and the second track are, in principle, arranged in the form of jigs mounted in a carousel-like manner, and accordingly each track comprises a rotating axle, having a number of jigs mounted on it, which jigs are provided with holding devices for holding and stepwise completion of the casing parts and slide parts, respectively, the axles of the rotating tables being capable of rotating, preferably step by step, to move their jigs between stations in fixed angular positions. Finished casing parts from the first rotating table are then transported to the second rotating table, where a finished slide part, from a jig in its final position, is inserted into each casing part supplied.

Preferably at least one of the rotating tables is arranged with fixed stations having mutual rotational angular intervals, the number of which per revolution being the same as the respective number of jigs. Suitably one unit is assembled per revolution, and therefore, during operation, the rotating tables revolve at a pace such that they mutually cover the same number of revolutions. However, the two rotating tables do not need to have the same number of jigs.

According to the invention the different work operations for picking, placing, folding etc. are suitably carried out by means of the control of a software in a computer, which accordingly will control electromagnetic and pneumatic or hydraulic manoeuvred devices, stepping motors etc. This provides a possibility to allow large parts of the control to take place with the aid of a computer and software, giving the special advantage of the possibility of keeping track of the amount packed. For example, the software can be executed so that only a certain number of packing operation are allowed until a new code is fed, which code only rightful parties have at their disposal. It is also possible to add a registration from a coded memory or the like, making it possible to withdraw a list with date, time and number of packages having being produced at each special occasion. Consequently, great possibilities are offered to reduce cheating and bootlegging.

As already mentioned, according to the invention there are rotating table tracks each having a number of jigs, intended for completion of casing parts and slide parts respectively, from flat work pieces, the slide parts being provided with discs, which parts subsequently are joined. A distinguishing quality of the casing part jigs is that they have placing areas, as well as U-shaped covers, which can be turned in the jigs, perpendicularly to the direction of rotation, and which can be placed on the placing areas, which covers mainly serves as "lasts", in that such a cover is placed on a casing work piece, placed on the placing area, which casing work piece, by means of devices which can be turned, located in the jig, as well as devices in the different stations, is then folded in gradual steps and glued around such a cover, to then finally be pulled off, as from a last used in shoe manufacturing, after which, in a later working operation, the "last" is replaced by the filled slide part. A special advantage with this jig system compared to the state of the art, is that the jig, with its clamping devices can hold the slide part in a constant and safe grip during a few station stops and squeeze the glue joints together, which glue joints are present in the casing parts which are stationary in relation to the respective jig, while the glue is adhering (melt glue).

A distinguishing quality of the jigs serving to manufacture the slide parts is that they, having a main part consisting of a placing plate with a rectangular opening, have clamping devices which can be lifted and turned, and by means of which folding and holding can be carried out, and which have vertical control axles which can be lifted and turned, and which are spring loaded downwards towards the placing plate, in the direction of the axle. Preferably these are controlled by means of control devices, arranged at different stations, which control devices are preferably pneumatically activated. The final work operation in the slide part rotating table consists in that the finished and filled slide part is inserted into a finished casing part, transported up to the slide part, after which the finished package is moved out.

BRIEF DESCRIPTION OF THE INVENTION

The invention will now be described in greater detail by means of a non-limiting embodiment example and with reference to the drawings.

DESCRIPTION OF THE PREFERRED EMBODIMENT

Figure 1:
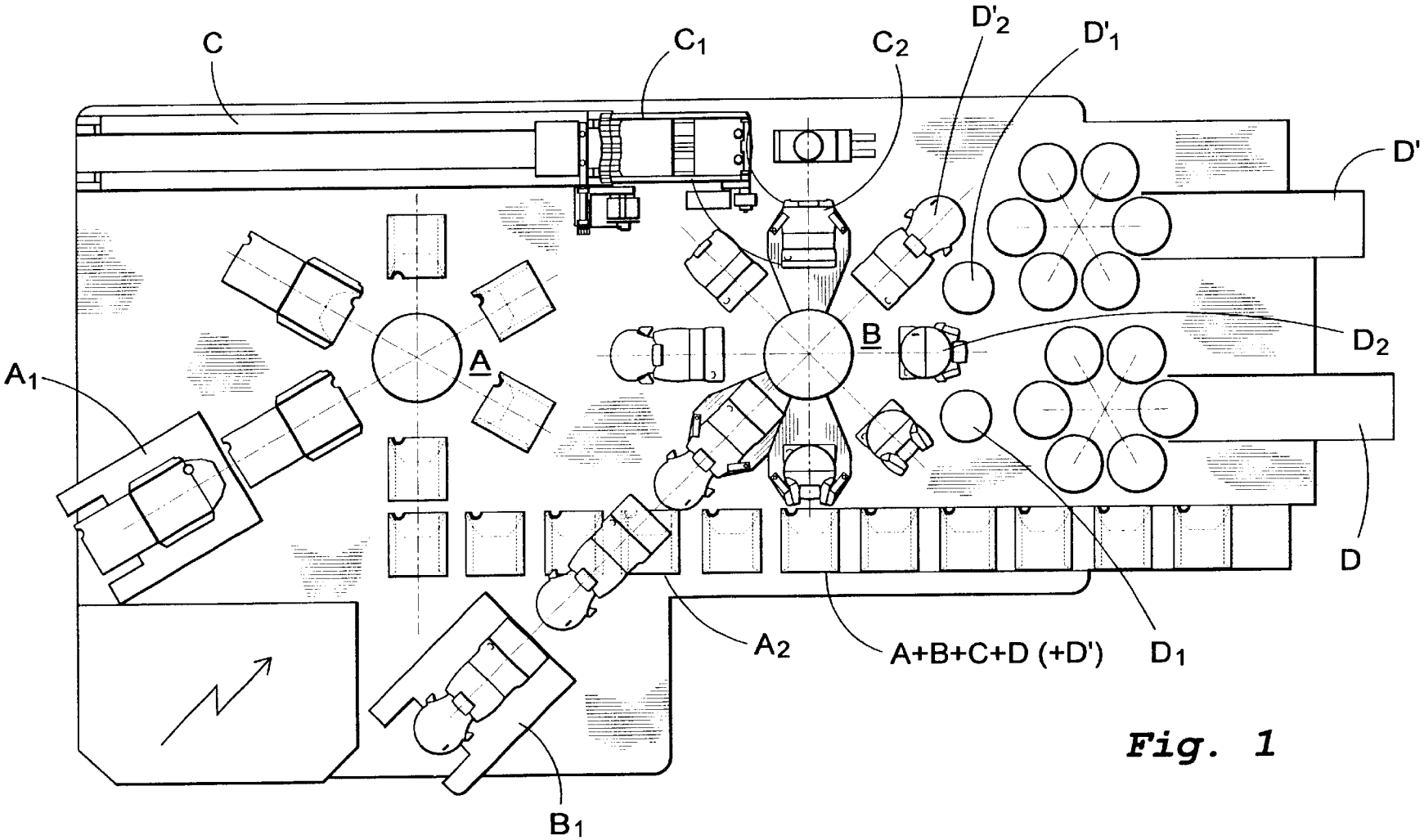
FIG. 1 shows a survey-like complete view from above of a machine for packaging of compact discs and the like, in which the different included stations and their positions are illustrated.

FIG. 1 shows schematically and from above a complete packaging set-up with its components. Two rotating table arrangements A and B are included, as well as additional surrounding equipment. The rotating table A has six jigs, which can be rotated step by step around a centre, starting from a supply A1 for casing work pieces, which after a step by step passage through the rotating table, which revolves counter-clockwise, are delivered in the form of finished casings to a conveyor A2. The rotating table arrangement B has eight jigs for the folding and filling of the slide parts for the casings. From a supply B1 the work pieces are placed onto the jigs for gradual forming and insertion of a booklet and one or two discs in different stations. Booklets are fed from a conveying belt C, by means of a suction-arm, not shown, and are placed on a two-seated conveyor, from which they are laid down at C2 onto the pardly folded slide parts, during which the booklets are turned 90°. Two delivery stations for discs D' and D, the stations in themselves being a known type in connection to the manufacturing of compact discs, have discs stored on spears. In each station there is room for six carousel mounted spears with piles of discs. From these supplies the delivery stations D'1 and D1 respectively are kept filled to a suitable level for lifting the top discs by means of suction-arms (not shown) in order to be lay them down onto the jigs at D'2 and D2, respectively.

The delivery station D' is only needed in the case one wants to insert two discs, at which the first, from D', is placed directly onto a booklet at D'1, before a separating plate is folded downwards over this. At the station D1 a disc is laid down on top of the separating plate, and during the continued rotation the jig approaches its final station (referred to as A+B+C+D(+D')), where the slide part is inserted into the casing, after which the finished package continues along the rest of the track A2 for being fed out. As will become clear from the continued description, different control devices are present around the placement of the jigs, plough devices for carrying out folding operations etc, which in the interest of clearness cannot be shown in this simplified figure.

Figure 2:
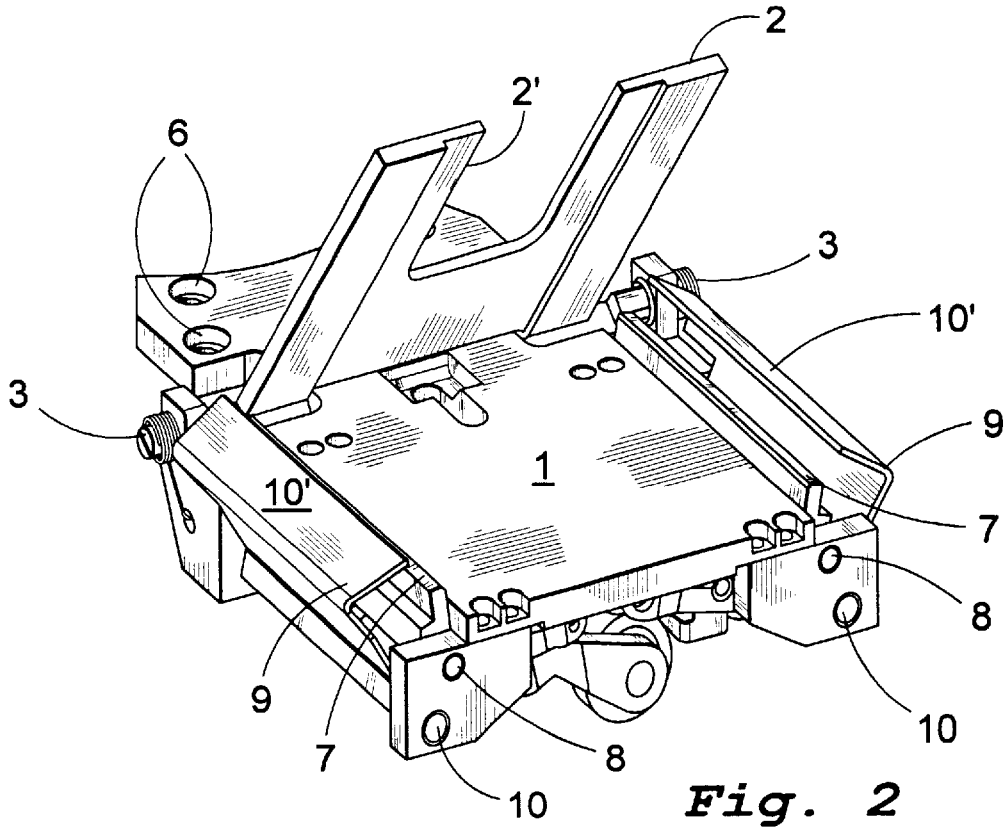
FIG. 2 shows a jig for the manufacturing of casing parts.

FIG. 2 shows schematically a jig for manufacturing casing parts. It has a placing plate 1, at which a cover 2 can be turned, which cover can be laid down against the placing plate and cover this. The cover 2 has a U-shaped recess 2' and can be turned around an axle 3, being mounted on bearings in posts. The cover can be controlled by means of flags, not shown, on the lower side. The placing plate 1, by which the rest of the details are moveable, can be screwed in place, onto a vertical rotating table axle, by means of the screw holes 6. First folding devices 7, can be turned, at axles 8, to a position in which they are in contact with and forms 90° angle with the placing plate 1. Second folding devices 9, mounted on bearings at axles 10, can be placed over, and cover, the upper edges of the contacting first folding devices 7, by means of horizontally contacting parts 10.

Figure 3A:
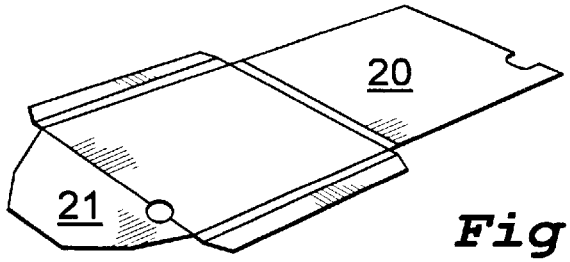
FIGS. 3A–3G show gradual folding steps in a perspective view for a casing part, as they would be performed in a first rotating table, the details of which are not shown.
Figure 3B:
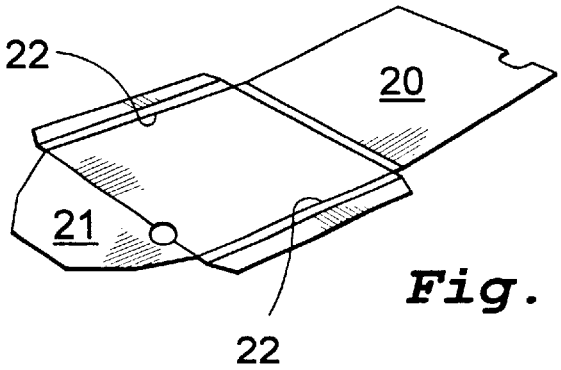
Figure 3C:
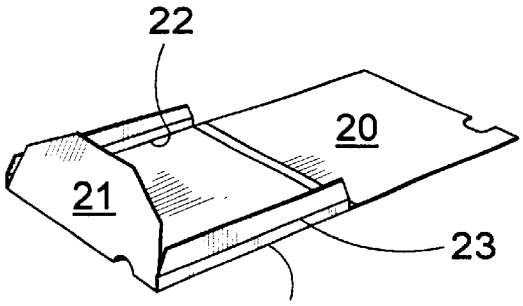
Figure 3D:
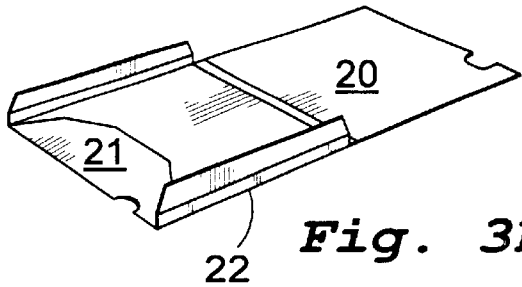
Figure 3E:
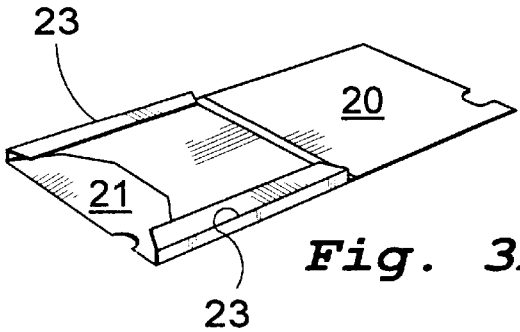
Figure 3F:
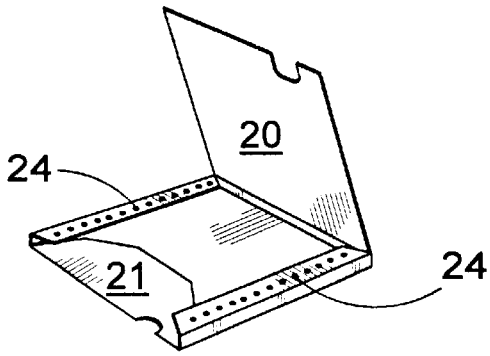
Figure 3G:
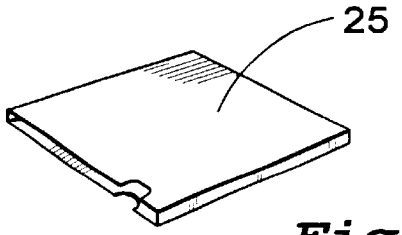

As already has been mentioned in the beginning, and schematically shown in FIG. 1, six jigs similar as to one shown in FIG. 2, are arranged in a rotating table and are moved around between fixed positions. One of these is a insertion position, right in front of a magazine with cardboard work pieces provided with folding notches, such as those shown in FIG. 3A. The top work piece is collected by means of an arm with suction-cups, at which, as shown in FIG. 3B an air nozzle lifts the rear part 20, after which the arm folds the work piece through a forming channel (not shown), so that the folds 22 (FIG. 3C) become folded upwards 90° but spring back slightly at the exit from the forming channel, at the same time as the flap 21 becomes folded slightly upwards. The arm then lays the work piece, formed according to FIG. 3C, down onto the placing plate 1 (FIG. 2). The cover 2 is laid down, something which is possible with remaining suction-cups, thanks to the recess 2'. Thereby the flap 21 becomes completely pressed downwards by the cover 2. Thereby the work piece is held, the suction-cups can be removed and the jig can be transported to the next station. The first folding devices 7 are turned from the position indicated in FIG. 2 towards standing upright, whereby the folds 22 becomes 90°, and the work piece obtains the shape shown in FIG. 3B. The second folding devices 9 are thereafter turned towards the placing plate and the first folding devices 7. The upper parts 10 of the second folding devices 9 places themselves horizontally above and against the upper edges of the first folding devices 7, during which cardboard comes in between, forming the folds 23. Subsequently, when the second folding devices are lifted off, melt glue 24 is applied by means of nozzles with sliding holding devices similar to the pressing foot on a sewing machine (not shown). Subsequently the large rear part 20 is folded over, see FIG. 3F, and is laid down against the folded flaps, coated with glue, after which the second folding devices 9 are once again laid down onto the work piece, which now has obtained the final shape as the casing 25 according to FIG. 3G. During a part of the rotating table revolution the glue joint is now subjected to pressure by means of the second holding devices holding it down, so that the melt glue is hardened. Finally, in a final station for the jig in the rotating table, the cover 2 is turned upwards around the axle 3—3 approximately 45°, with the casing part being put on, after which the finished casing is pulled off, turned and placed onto a conveyor (A2 in FIG. 2) for being transported to the point, at which it is to be united with the slide part. The jig continues to its original position, in which a new work piece is placed etc.

Figure 4:
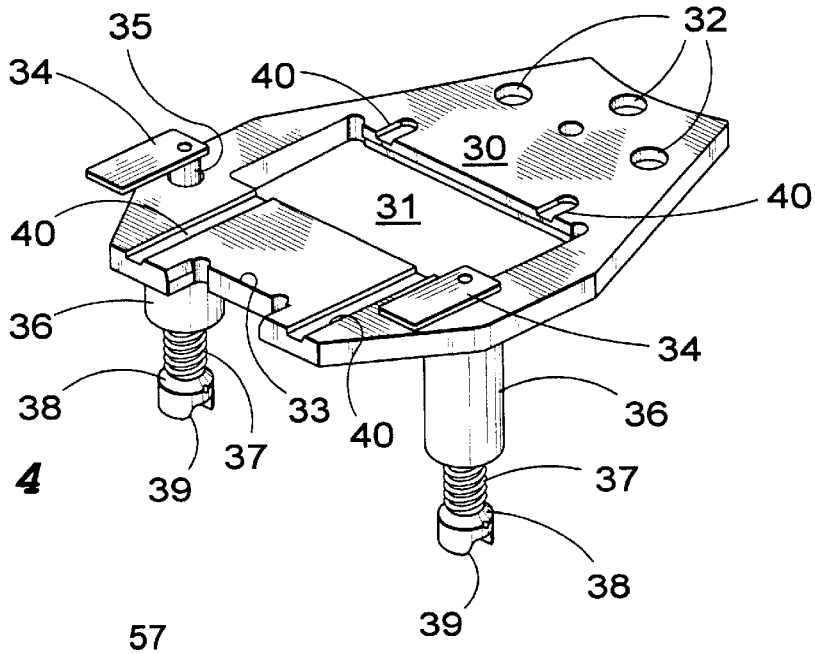
FIG. 4 shows a jig for the manufacturing and filling of slide parts.

As mentioned the slide part for the casing is manufactured in a different rotating table (B in FIG. 1) having jigs. Such a jig is shown in FIG. 4 and consists of a placing plate 30 with an opening 31 and fastening holes 32 at one end, for fastening it on the rotating table and at the other free end a recess 33. Clamping devices 34, which can be lifted and turned, are mounted on vertical axles 35, inserted through sleeves 36 solidly arranged underneath the placing plate. The axles 35 are spring-loaded with helical springs 37, arranged between the sleeves 36 and control heads 38, provided with shoulders and mounted on the axle ends, at which the helical springs 37 rest against the shoulders. At different stations, the clamping devices 34 can be controlled in the longitudinal direction for lifting the clamping devices 34 and turning them radially, by means of the control heads 38 and their screw driver slots 39. The two clamping devices 34 are shown in FIG. 4, in different positions, at which the left one in the figure is pressed further upwards from beneath with the aid of means not shown in this figure. When not controlled the clamping devices will pinch whatever has been brought between these and the placing plate 30, because of which transportation of a slide part, partly finished, can take place from one fixed position to the next one. Thus, control by means of the control heads 38 takes place in one of the fixed positions shown in FIG. 1, when the jig is not moving. Also, longitudinal tracks 40 are provided in the jig, which tracks serve to let output devices push the finished slide part outwards, which is described closer here below.

Figure 5A:
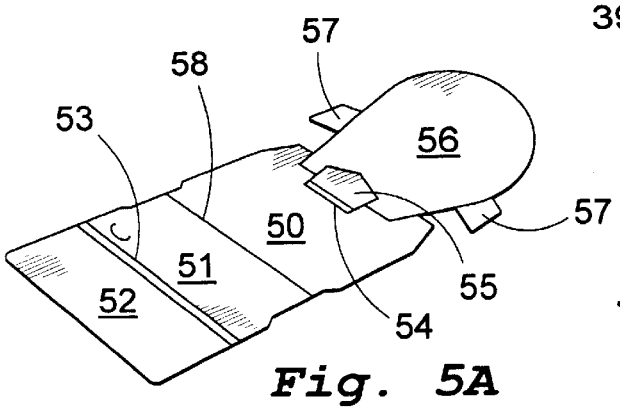
FIGS. 5A–5F show gradual folding steps in a perspective view for a slide part, such as these are performed in a second rotating table, the details of which are not shown.

The jig in FIG. 4 is now used for folding the slide parts and placing discs and booklets on a slide part to be put in a casing part. FIG. 5A shows a cardboard work piece, in which a bottom plate 50, 51, separated with a folding notch 58, a lid flap 52, separated from the bottom plate by means of a double fold 53, a locking flap 55 and a separating plate 56, provided with flaps 57, can be seen.

Figure 5B:
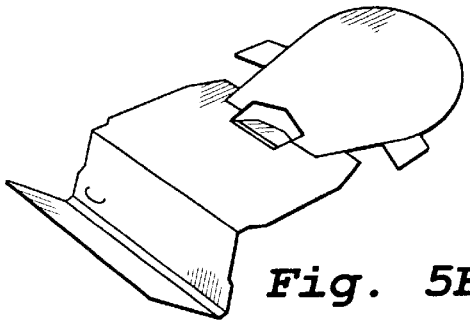
Figure 5C:
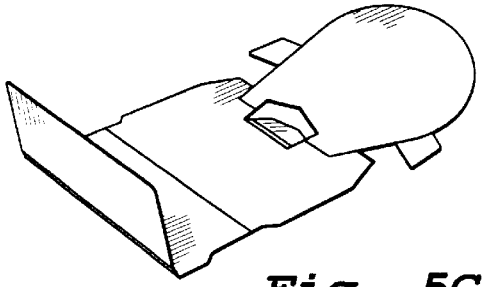
Figure 5D:
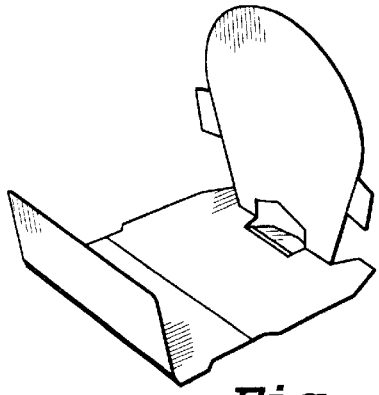
Figure 5E:
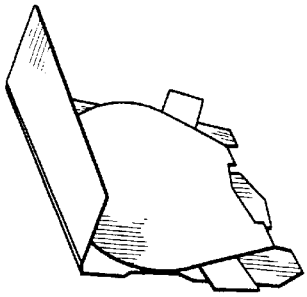
Figure 5F:
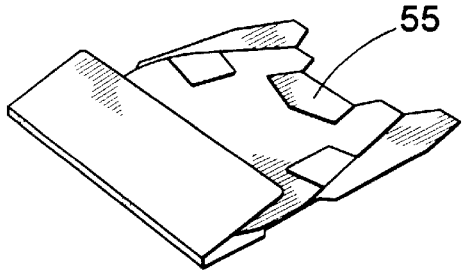
Figure 6:
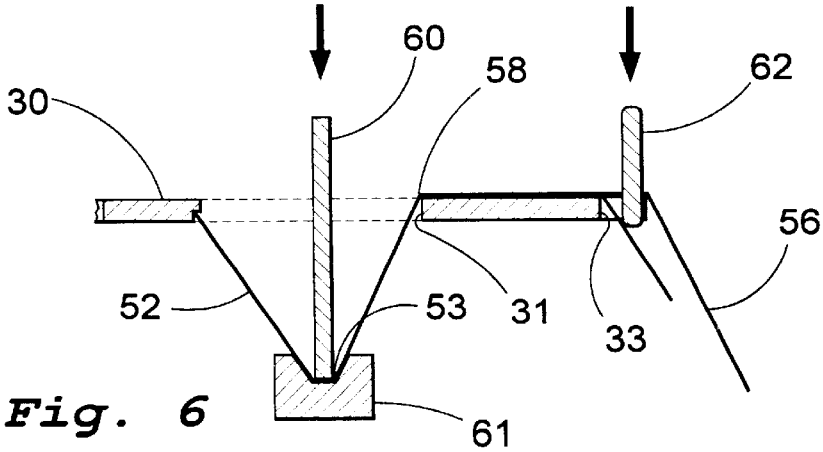
FIG. 6 shows, in cross section, a step in the manufacturing of slide parts.

The cardboard work piece in FIG. 5A has a width corresponding to the width of the opening 31 in the jig (FIG. 4), and the distance between the axles 35 is larger than the width of the work piece, which therefore can be placed onto the placing plate 30 without any obstacles. The cardboard work pieces are fetched one by one from a magazine (B1 in FIG. 1) by means of a suction-cup arm, and are inserted with the straight edge first and far enough for the folding notch 58 to be placed right in front of the closest edge of the opening 31 in the jig, while the folding notch 54 for the locking flap 55 comes to be by the edge of the recess 33, after which the clamping devices 34 are turned and laid down over the cardboard to hold it. In the next station (see the cross section figure FIG. 6) a stamp 60 with a head having the same width as the distance between the double folds 53 and a length corresponding to the width of the work piece, is brought to travel downwards through opening 31 and press the cardboard through the opening 31, underneath which, at the station, a work rest 61 is provided at the correct height and with a complementary profile, so that the double fold 53 becomes folded, at the same time as the fold 58 becomes folded approximately 60° against the edge of the opening 31. Another device 62 approaching from above, which device has a smaller dimension in the direction of the width of the jig, presses the locking flap 55 downwards at the same time, and after this the work piece has the shape shown in FIG. 5B. In the next station the work piece is pushed back out of the opening so that the fold 58, which became folded against the forward edge of the opening 31 (FIG. 4), becomes straightened out. Possibly the separation plate 56 is placed slightly downwards at this point, in order to be out of the way when a booklet and possibly an extra disc is placed subsequently in a position as shown in FIG. 5C, during it being pressed down so that the clamping devices 34 can be manoeuvred out of the way temporarily (FIG. 4), since the clamping devices otherwise would be in the way for laying down a booklet or possibly a disc. Thereafter the separation plate 56 is folded over the booklet and the optional extra disc (FIGS. 5D, 5E), and a disc is placed, by means of an arm provided with a suction-cup, on top of the separation plate 56, in a position shown in FIG. 5E. During the time in which the arm, laying the disc down, holds the whole thing together, the clamping devices 34 can now be lifted, and turned to fold the flaps 57 over the disc and hold the whole thing, after which the slide part is complete. In a subsequent step the flap 52 is folded downwards, and the locking flap 55 is folded upwards on top of the disc by means of ploughing carried out during the transportation of the rotating table to the next fixed position, so that the shape shown in FIG. 5F is obtained, with a disc, booklet and optional second disc inserted.

As shown in FIG. 1, the last station for the jig is provided right in front of and perpendicularly to the conveyor A2, which has gaps for finished casings 25, and accordingly right in front of and perpendicularly directed towards the opening of the casing 25. The conveyor is fed stepwise so that a jig and a casing part ends up with sufficient accuracy right in front of each other. The separating walls in the conveyor allow a possible total play for the casing parts of approximately 5 mm.

Figure 7:
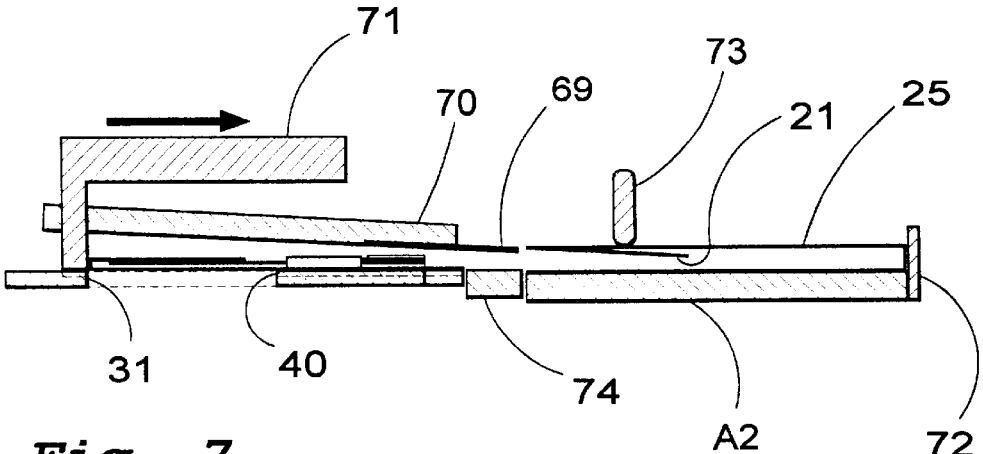
FIG. 7 shows, in a schematic cross section, how a finished sliding part is inserted directly from the jig, in which it has been finished, into a completed casing part, transported up to the slide part.

As shown in the cross section view of FIG. 7, down holding devices 69 and 70 are provided, which are lowered towards the finished slide part on the jig and hold the slide part together and for this reason the clamping devices 34 (FIG. 4) can now be moved out of the way. Thereafter claw devices 71 grips into the tracks 40 (FIG. 4) to subsequently push the slide part out from the jig. The rear edge of the body is placed approximately at the same level as the rear edge of the opening 31, and because of this the grip of the claw devices 71 in the tracks 40 can take place behind the slide part, which are then pushed forward by means of the movement of the claw devices, at which the down holding devices 69 and 70 are disposed in such a way that they leave room to the claw devices 71 for their movement (not shown). Accordingly this slide part will be fed towards the opening of the casing part 25, which is held in place in the conveyor by means of a work rest 72 and a boom 73 brought downwards. Possibly a bridge part 74 is provided between the position the jig and the conveyor A2. As is shown in FIG. 5F the finished slide part has bevelled end sides, so that a small misplacement of the casing part 25, being slightly moveable in a side-way direction, will be corrected, and accordingly the slide part will now by means of the continued movement of the claw devices 71 be pushed into the casing part. Thereafter, the down holding devices 69 and 70 as well as the claw devices 71 will be lifted upwards, in addition to which none of these devices rotates with the movement of the rotating table, rather they belong to the last station, so that the following jig with a finished slide part will be able to rotate up to the final position in the last station, to which the conveyor A2 then transports a new empty casing part.

It is understood that, as soon as the locking flap 55 (FIG. 5F) in the slide part, which locking flap is folded over the disc, has been inserted with its free end passed the free end of the locking flap 21 in the finished casing part, these locking flaps will hook into each other during a subsequent out-pulling manoeuvre of the slide part, and prevent further extraction. Consequently the casing part and the slide part becomes an un-dividable unit, in connection to which the disc, the booklet and the optional second disc can be withdrawn and inserted in a comfortable manner at the slide part, withdrawn until stopped, which is also described in the publication WO/97/38919.

In addition to the shown devices, as well as the arms provided with vacuum suction-cups, collecting and laying down cardboard work pieces, booklet and disc/discs, functional equipment is provided in the different stations for carrying out the different manoeuvres described. It is also possible to allow some manoeuvres to take place during the performance of movements of a jig between two stations, which movements are carried out through computer control. For example, during the manufacturing of the casing part, the manoeuvre ears for the cover 2 and the control devices for the folding devices 7, 9, respectively, (not shown) which manoeuvre ears are placed underneath, can be acted upon during the rotation of movement of the jig by means of cam surfaces. Additionally, concerning the slide part, the separating plate 56 between the position in FIG. 5B and in FIG. 5C, can be turned downwards by means of a cam surface in order to not be in the way when a booklet and an optional disc is laid down, for subsequently in the same manner by means of a cam surface during the rotation of the jig from one station to another be folded over, at least as far as shown in FIG. 5D.

All the different operations take place in a carefully adjusted time sequence and under the control of a computer. The rotation of the rotating table preferably takes place by means of stepping motors, possibly connected to the rotational axles by means of cam belts. These operating means are located underneath and are not shown. As has already been suggested, some folding operations take place by the respective jig passing cam surfaces during a movement from one station to the next, while other movements of different devices take place by means of computer control of pneumatic cylinder devices under the supervision of light forks, the signals of which are guided to the computer. By means of a pace adjustment thereby being made possible, mechanical complications are avoided to a high degree, and, additionally, a software control is obtained, which, to anyone who does not possess the source code of the software, makes it sufficiently complicated for it not to be reconstructed and for making it unprofitable to try to avoid a volume check, desirable above all from record producers' point of view.

What is claimed is:

1. A machine for folding a filling packages for one or a plurality of disc shaped products, which packages are composed of a flat, four sided casing part, and a slide part inserted by pushing it into the casing part, and corresponding to the biggest dimension of the disc shaped product, made from a casing work piece and a slide part work piece, punched from cardboard, said machine comprises a first track for folding and attaching the casing parts, a second track for folding the slide parts and putting at least one disc shaped product into each of the slide parts, and means for combining, in pairs, each finished casing part with a filled and finished slide part, and for insertion of the latter into the former, wherein the first and second track (A, B) having rotating tables, each of the rotating tables comprises a rotating axle having a number of jigs mounted on said rotating axle, said jigs are provided with holding devices for holding and stepwise completion of the casing parts and the filled and finished slide parts respectively, the axle is being rotated to move their jigs between stations in fixed angle positions, and a conveyor (A2) arranged to transfer the finished casing parts removed from the casing jigs up to the slide part jig moved into a final position and having the filled and finished slide part, a pusher (71) at the final position of said slide part jig, and a down-keeping device (70) for holding the filled and finished slide part together until an insertion end of the filled and finished slide part has been inserted into the finished casing part.

2. A machine according to claim 1, characterised in that the jigs of at least one of the tracks have a number of stations with fixed angled positions having rotational angular intervals in relation to each other, the number of intervals per revolution being the same as the number of jigs.

3. A machine according to claim 1, characterised in that each track has a first jig position straight in front of a supply of work pieces for casing parts and slide parts (A1, B1), respectively, and work piece inserters for inserting work pieces, one by one in the respective jigs, positioned in their first jig positions.

4. A machine according to claim 1, characterised in that the jigs for folding casing parts have a placing plate (1) with side edges, the distance between the side edges corresponding to the width of the finished casing, a cover (2), which can be turned for being put down on the placing plate (1), covering this, and having a thickness corresponding to the inner dimension of the finished casing, first folding devices (7), which can be turned towards said side edges of the positioning plate (1) to present a perpendicular contact and a height above the placing plate corresponding to the thickness of the finished casing, and second folding devices (9) which can be turned in a direction towards the side edges of the placing plate (1), at the first folding devices (7), being turned to their contact positions, and provided with contact sections (10) for a horizontal contact with the upper edges of the first folding devices (7).

5. A machine according to claim 1, characterised in that each jig for folding slide parts has a placing plate (3) and, at an end, fastening means (32), for its fastening at a rotating table, and, at an opposite end, a recess (33), placed in the middle and on each side, a clamping device (34), being vertically adjustable and which can be turned horizontally around an axle, the distance between the axles (35) exceeding the width of a slide part work piece, the movements of said clamping devices being arranged to be controlled from the axle ends, protruding below the placing plate (30).

6. A machine according to claim 5, characterised in that the clamping device axle ends, protruding below the placing plate (30) are spring loaded in a direction, in which the clamping devices (34) are pulled towards the placing plate, and have controllable turning and lifting devices (38, 39).

7. A machine according to claim 5, characterised in that a rectangular opening (31) is made in the placing plate (30), which opening has an extension in a direction which is perpendicular to the direction connecting said ends, which extension corresponds to the width of a slide part work piece.

8. A machine according to claim 7, characterised in that one of the stations for the movement positions of the jig is provided with a work rest (61), placed below the position of said opening (31) of the jig and having a recess with a width corresponding to a double folding notch (53) in a slide part work piece, in addition to which a stamp, with a shape being complementary to the recess, is arranged to be pressed down from above at the station, against a slide part work piece placed over the opening of the placing plate (30), and down to and against the work rest, for engagement of the double folding notches between the stamp and the work rest.

* * * * *